US010323873B2

(12) United States Patent
Navarro et al.

(10) Patent No.: US 10,323,873 B2
(45) Date of Patent: Jun. 18, 2019

(54) MODULAR ISLAND MERCHANDISER

(71) Applicant: Hussmann Corporation, Bridgeton, MO (US)

(72) Inventors: Moisses Navarro, Rancho Cucamonga, CA (US); Diego Wood, Corona, CA (US); Raymond P. Twohy, Saint Peters, MO (US); Kevin A. Moody, West Covina, CA (US); Michael A. Gillett, Rancho Cucamonga, CA (US); Anand Ganesh Rajagopalan, Anaheim, CA (US); Robert Mullen, Anaheim, CA (US); Al Arrosagaray, Rancho Cucamonga, CA (US)

(73) Assignee: Hussmann Corporation, Bridgeton, MO (US)

( * ) Notice: Subject to any disclaimer, the term of this patent is extended or adjusted under 35 U.S.C. 154(b) by 722 days.

(21) Appl. No.: 14/036,819

(22) Filed: Sep. 25, 2013

(65) Prior Publication Data

US 2014/0021834 A1 Jan. 23, 2014

Related U.S. Application Data

(63) Continuation of application No. 12/829,518, filed on Jul. 2, 2010, now Pat. No. 8,561,419.

(51) Int. Cl.

| | |
|---|---|
| ***F25D 11/02*** | (2006.01) |
| ***A47F 3/04*** | (2006.01) |
| ***A47F 10/02*** | (2006.01) |

(52) U.S. Cl.

CPC ..... *F25D 11/02* (2013.01); *A47F 3/0439* (2013.01); *A47F 10/02* (2013.01); *Y10T 29/49359* (2015.01)

(58) Field of Classification Search

CPC .... A47F 3/0439; A47F 3/0404; A47F 3/0434; A47F 3/0452; A47F 3/005; A47F 3/007; F25D 11/02; F25D 11/022

(Continued)

(56) References Cited

U.S. PATENT DOCUMENTS

| | | | |
|---|---|---|---|
| 1,881,541 | A | 10/1932 | Harrison |
| 2,171,378 | A | 8/1939 | Urbanek |

(Continued)

FOREIGN PATENT DOCUMENTS

| | | |
|---|---|---|
| EP | 1467164 | 10/2004 |
| JP | 3051684 | 3/1991 |

(Continued)

OTHER PUBLICATIONS

Hill Phoenix, "Installation & operation Handbook" for end cap merchandiser of Meat, Rev. 5, Aug. 2009, p. 3-32.*

(Continued)

*Primary Examiner* — Frantz Jules
*Assistant Examiner* — Erik Mendoza-Wilkenfe
(74) *Attorney, Agent, or Firm* — Michael Best & Friedrich LLP

(57) ABSTRACT

An island merchandiser including a first merchandiser module, a second merchandiser module, and a single, unitary base. The first merchandiser module includes a first case defining a first product display area that is maintained within a predetermined temperature range below approximately 41 degrees Fahrenheit. The second merchandiser module is positioned next to the first merchandiser module, and includes a second case defining a second product display area The second merchandiser module is positioned so that a rear wall of the second case is in communication with a rear wall of the first case so that the first and second merchandiser modules are positioned in a back-to-back (Continued)

relationship. The unitary base is positioned to at least partially support each of the first and second merchandiser modules relative to a support surface. The module defined by the second merchandiser module is different from the module defined by the first merchandiser module.

21 Claims, 9 Drawing Sheets

(58) Field of Classification Search
USPC ..... 62/442, 246–256; 312/116, 401, 128, 312/137; 108/108, 26
See application file for complete search history.

(56) References Cited

U.S. PATENT DOCUMENTS

| | | | | |
|---|---|---|---|---|
| 2,421,896 | A | 6/1947 | MacMaster | |
| 2,425,295 | A | 8/1947 | Morris | |
| 2,894,604 | A | 7/1959 | McMillan | |
| 2,900,045 | A | 8/1959 | Conklin et al. | |
| 2,929,227 | A | 3/1960 | Rainwater | |
| D188,268 | S | 6/1960 | Rainwater | |
| 3,046,757 | A | 7/1962 | Bank | |
| 3,162,495 | A | 12/1964 | Swift | |
| D212,399 | S | 10/1968 | Kimler | |
| 3,459,116 | A | 8/1969 | McDonnell | |
| 3,729,243 | A | 4/1973 | Musgrave et al. | |
| 3,730,603 | A | 5/1973 | Looms | |
| 4,165,620 | A * | 8/1979 | Gehauf nee Kiesel et al. | 62/256 |
| D280,476 | S | 9/1985 | McMahon et al. | |
| D294,316 | S | 2/1988 | Jakubowski | |
| 4,836,622 | A | 6/1989 | Ferguson | |
| 4,840,439 | A | 6/1989 | Nara et al. | |
| 4,949,554 | A | 8/1990 | Branz et al. | |
| 5,088,626 | A | 2/1992 | Patton et al. | |
| 5,201,191 | A | 4/1993 | Bustos | |
| 5,301,517 | A | 4/1994 | Bustos | |
| 5,336,049 | A * | 8/1994 | Herman | A47F 3/0439 312/236 |
| 5,499,513 | A | 3/1996 | Bustos | |
| 5,517,826 | A | 5/1996 | Duffy | |
| 5,584,192 | A | 12/1996 | Bustos | |
| D378,176 | S | 2/1997 | Feldman | |
| 5,964,512 | A | 10/1999 | Borgen | |
| 6,257,010 | B1 | 7/2001 | Shei et al. | |
| 6,381,972 | B1 * | 5/2002 | Cotter | A47F 3/0439 62/126 |
| 6,683,282 | B2 | 1/2004 | McMahon et al. | |
| 6,735,970 | B1 | 5/2004 | Bocchini | |
| 6,912,864 | B2 | 7/2005 | Roche et al. | |
| 7,062,931 | B2 | 6/2006 | Wilson | |
| 7,263,843 | B1 | 9/2007 | Nordstrom | |
| RE40,151 | E | 3/2008 | Shei et al. | |
| D569,880 | S | 5/2008 | Ugarte | |
| 7,591,144 | B2 | 9/2009 | Wilson et al. | |
| 8,561,419 | B2 | 10/2013 | Navarro et al. | |
| 2002/0043906 | A1 | 4/2002 | Dewitt et al. | |
| 2002/0072323 | A1 | 6/2002 | Hakemann | |
| 2004/0031280 | A1 * | 2/2004 | Martin et al. | 62/246 |
| 2004/0177634 | A1 * | 9/2004 | Yamazaki et al. | 62/248 |
| 2005/0097910 | A1 | 5/2005 | Nakajima et al. | |
| 2006/0010894 | A1 | 1/2006 | Wilson | |
| 2006/0168978 | A1 | 8/2006 | Suda et al. | |
| 2006/0207281 | A1 | 9/2006 | Suda et al. | |
| 2007/0062209 | A1 * | 3/2007 | Giulietti | 62/246 |
| 2007/0119113 | A1 * | 5/2007 | Keller | 52/506.01 |
| 2009/0044553 | A1 | 2/2009 | Tilley | |
| 2009/0084125 | A1 * | 4/2009 | Fung | 62/255 |
| 2009/0249811 | A1 | 10/2009 | Shin | |
| 2010/0313588 | A1 * | 12/2010 | Swofford et al. | 62/251 |

FOREIGN PATENT DOCUMENTS

| | | |
|---|---|---|
| JP | 4244574 | 9/1992 |
| JP | 11113700 | 4/1999 |
| WO | 2012003056 | 1/2012 |

OTHER PUBLICATIONS

Hill Phoenix, "Multi-Deck Deli/Meat End Cap Merchandiser" product description brochure, Feb. 2010, 4 pages.
Barker Sales, "PFI-5 Series 5' Wide Self-Service Deli Island Merchandiser" product description brochure, May 1, 2008, 2 pages.
Barker Specialty Products, LLC, "PF Island with glass angled ends" from http://www.barkercompany.com/portfolio/item.barker?id=7, 2010, accessed at least as early as Jul. 2, 2010, 1 page.
Hill Phoenix, "Installation & Operation Handbook" for End Cap Merchandiser of Meat, Rev. 5 (2009) p. 3-32.
International Search Report and Written Opinion for Application No. PCT/US2011/037350 dated Dec. 12, 2011 (8 pages).
International Preliminary Report on Patentability for Application No. PCT/US2011/037350 dated Jan. 17, 2013 (2 pages).

* cited by examiner

MODULAR ISLAND MERCHANDISER

BACKGROUND

The present invention relates to an island merchandiser, and more particularly, the present invention relates to an island merchandiser including at least two merchandiser modules positioned adjacent and coupled to each other.

In conventional practice, commercial businesses such as supermarkets and convenience stores are equipped with various merchandisers (e.g., refrigerated merchandisers, heated merchandisers, and ambient temperature merchandisers) including product display areas that support and display product (fresh or frozen product, beverages, condiments, dry goods, etc.). Often, the merchandisers are positioned side-by-side in a row and display similar product (e.g., meat product).

SUMMARY

In one construction, the invention provides an island merchandiser including a first merchandiser module, a second merchandiser, and a single, unitary base that is positioned to at least partially support each of the first and second merchandiser modules relative to a support surface. The first merchandiser module includes a first case that has side walls and a rear wall at least partially defining a first product display area. At least a portion of a refrigeration system is coupled to the case and has an evaporator in communication with the first product display area to maintain the first product display area within a predetermined temperature range below approximately 41 degrees Fahrenheit such that the first merchandiser module defines one of a medium temperature module and a low temperature module. The second merchandiser module is positioned next to the first merchandiser module. The second merchandiser module includes a second case that has side walls and a rear wall at least partially defining a second product display area. The rear wall of the second case is in communication with the rear wall of the first case so that the first merchandiser module and the second merchandiser module are positioned in a back-to-back relationship. The second merchandiser module defines one of a high temperature module, an ambient temperature module, a medium temperature module, and a low temperature module, and the module defined by the second merchandiser module is different from the module defined by the first merchandiser module.

In another construction, the invention provides method of assembling an island merchandiser. The method includes positioning a first merchandiser module in a single, unitary base, positioning a second merchandiser module in the unitary base adjacent the first merchandiser module, and positioning a third merchandiser module in the unitary base adjacent the first merchandiser module and the second merchandiser module. The first merchandiser module includes a first case that has side walls and a rear wall at least partially defining a first product display area maintained at a temperature below approximately 41 degrees Fahrenheit. The second merchandiser module includes a second case that has side walls and a rear wall at least partially defining a second product display area maintained at a temperature above approximately 32 degrees Fahrenheit. The third merchandiser module includes a third case that has side walls and a rear wall at least partially defining a third product display area maintained at a temperature above approximately 41 degrees Fahrenheit. The method further includes orienting the first merchandiser module and one of the second merchandiser module and the third merchandiser module in back-to-back relationship, orienting the other of the second merchandiser module and the third merchandiser module relative to the first merchandiser module so that the rear wall of the other of the second merchandiser module and the third merchandiser module is in communication with one of the side walls of the first merchandiser module, and after positioning and orienting the first, second, and third merchandiser modules in the unitary base, placing the island merchandiser on a support surface in a retail setting.

In yet another construction, the invention provides an island merchandiser including a first merchandiser module, a second merchandiser module positioned next to the first merchandiser module, and a third merchandiser module positioned next to the first merchandiser module and the second merchandiser module. The first merchandiser module includes a first case that has side walls and a rear wall at least partially defining a first product display area. At least a portion of a refrigeration system is coupled to the case and has an evaporator in communication with the first product display area to maintain the first product display area within a predetermined temperature range below approximately 41 degrees Fahrenheit such that the first merchandiser module defines one of a medium temperature module and a low temperature module. The second merchandiser module includes a second case that has side walls and a rear wall at least partially defining a second product display area. The rear wall of the second case in communication with the rear wall of the first case so that the first merchandiser module and the second merchandiser module are positioned in a back-to-back relationship. The second merchandiser module defines one of a high temperature module, an ambient temperature module, a medium temperature module, and a low temperature module. The third merchandiser module includes a third case that has side walls and a rear wall at least partially defining a third product display area. The rear wall of the third case is in communication with one of the side walls of each of the first case and the second case. The island merchandiser also includes a base positioned to at least partially support each of the first, second, and third merchandiser modules relative to a support surface. The module defined by the second merchandiser module is different from the module defined by the first merchandiser module, and the rear wall of the third case is sized and shaped to conform to the cooperative size and shape of the side walls of the first case and the second case.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
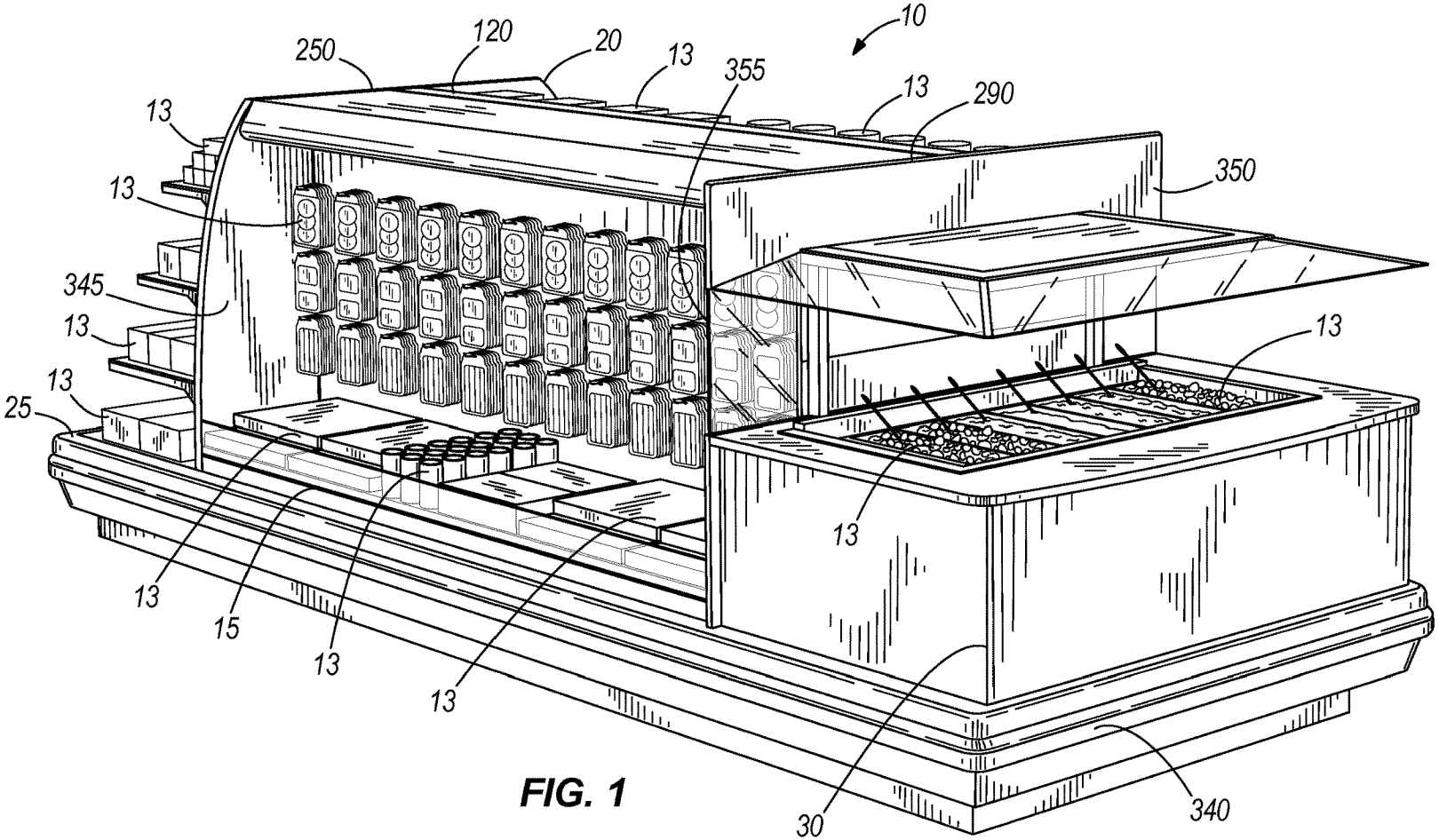
FIG. 1 is a perspective view of an island merchandiser including first, second, third, and fourth merchandiser modules embodying the invention.
Figure 2:
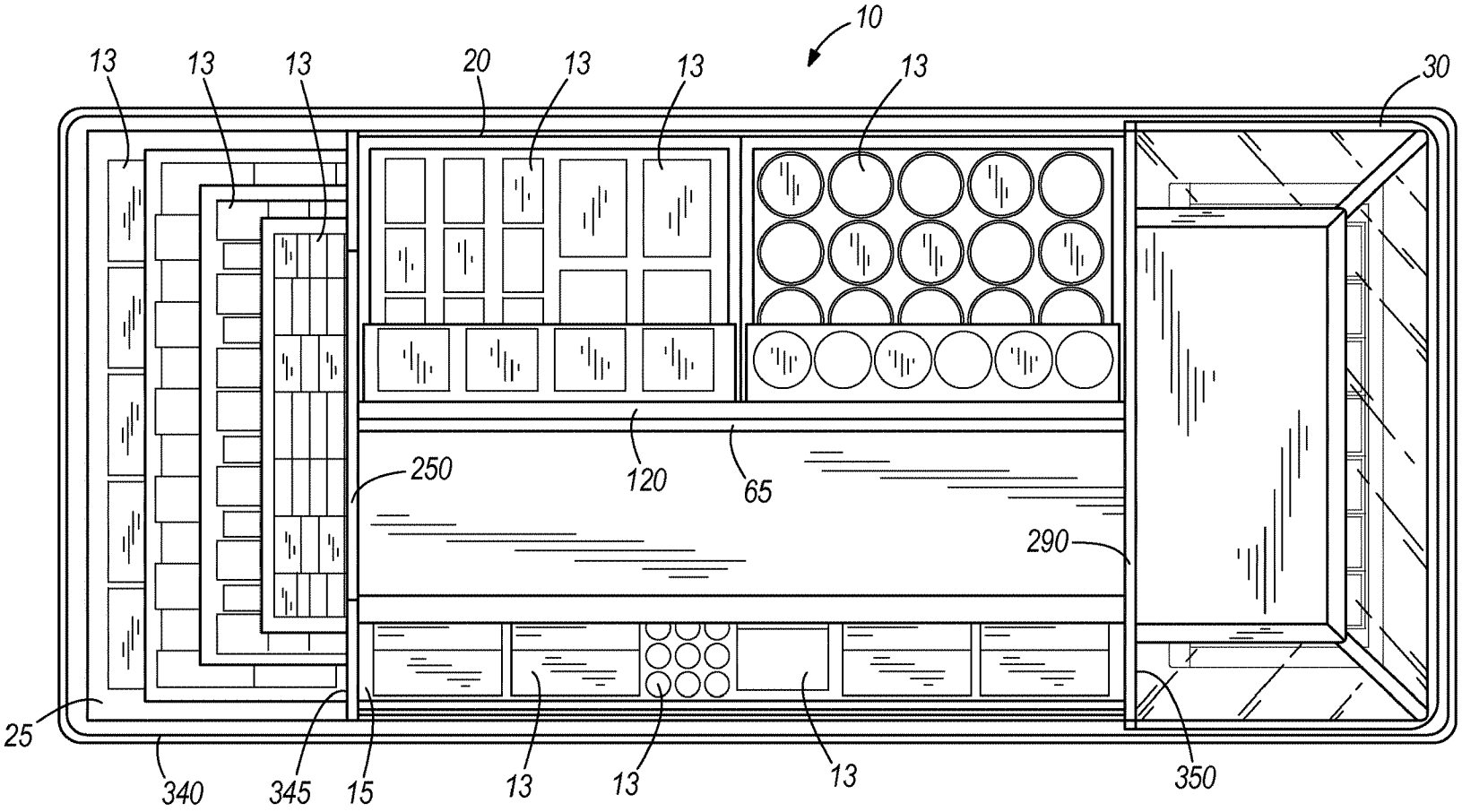
FIG. 2 is a top view of the island merchandiser of FIG. 1.
Figure 3:
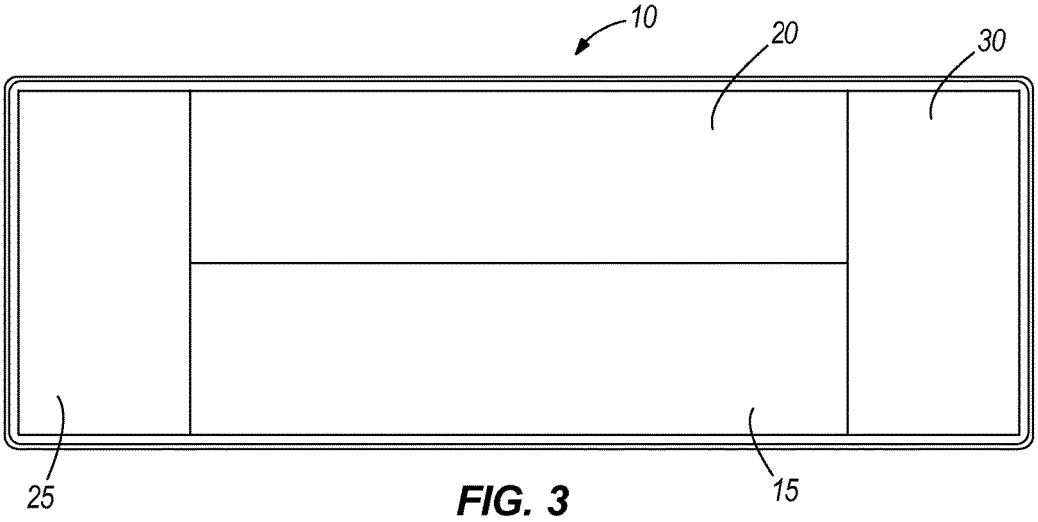
FIG. 3 is a schematic top view of the island merchandiser of FIG. 1.

FIGS. 1-3 show an exemplary island merchandiser 10 for supporting and displaying product 13 (e.g., frozen food, fresh food, beverages, etc.) available to consumers in a retail setting (e.g., a supermarket or grocery store, etc.). The island merchandiser 10 includes a first merchandiser module 15, and a second merchandiser module 20 positioned adjacent and in back-to-back relationship with the first merchandiser module 15 in the retail setting. The island merchandiser 10 also includes a third merchandiser module 25 positioned adjacent respective ends of the first and second merchandiser modules 15, 20, and a fourth merchandiser module 30 positioned adjacent respective ends of the first and second merchandiser modules 15, 20 opposite the third merchandiser module 25. Generally, the first and second merchandiser modules 15, 20 are defined as "center" modules of the island merchandiser 10 each having a width and a first predetermined length (e.g., 4 feet, 5 feet, 6 feet, 8 feet, 10 feet, 12 feet, etc). The third and fourth merchandiser modules 25, 30 are defined as "end" modules of the island merchandiser 10 each having a second predetermined length (e.g., 5.5 feet) that corresponds to the combined width of the first and second merchandiser modules 15, 20 such that the island merchandiser 10 has a substantially rectangular footprint. Other footprints of the island merchandiser 10 are also possible depending on the shape of the merchandiser modules that form the island merchandiser 10.

Figure 4:
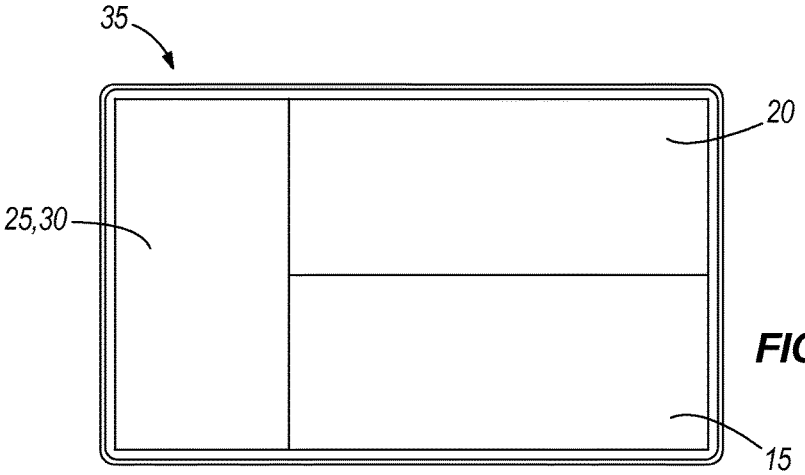
FIG. 4 is a schematic top view of another island merchandiser including first, second, and third merchandiser modules embodying the invention.

FIG. 4 shows another island merchandiser 35 that is similar to the island merchandiser 10 described with regard to FIGS. 1-3. The island merchandiser 35 includes three merchandiser modules positioned next to each other. For example, the island merchandiser 35 can include two center merchandiser modules (e.g., the first and second merchandiser modules 15, 20) positioned adjacent and in back-to-back relationship relative to each other in the retail setting, and one end merchandiser module (e.g., either the third merchandiser module 25 or the fourth merchandiser module 30) positioned on the ends of the two center merchandiser modules. Alternatively, the island merchandiser 35 can include three end merchandiser modules (e.g., the third and fourth merchandiser modules 25, 30 and another end merchandiser module).

Figure 5:
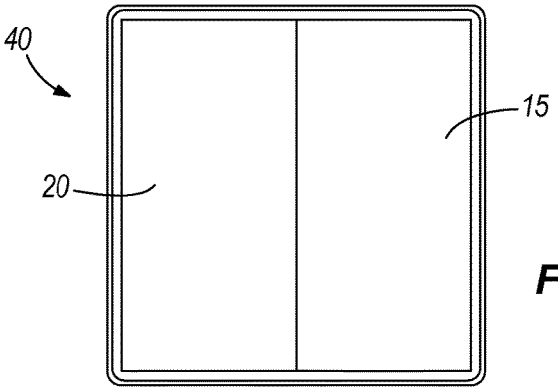
FIG. 5 is a schematic top view of another island merchandiser including first and second merchandiser modules embodying the invention.

FIG. 5 shows another island merchandiser 40 that includes two merchandiser modules positioned next to each other in back-to-back relationship. For example, the island merchandiser 40 can include two center merchandiser modules (e.g., the first and second merchandiser modules 15, 20) positioned adjacent and in back-to-back relationship relative to each other in the retail setting. Alternatively, the island merchandiser 40 can include two end merchandiser modules (e.g., the third and fourth merchandiser modules 25, 30) positioned adjacent and in back-to-back relationship relative to each other in the retail setting.

Figure 6:
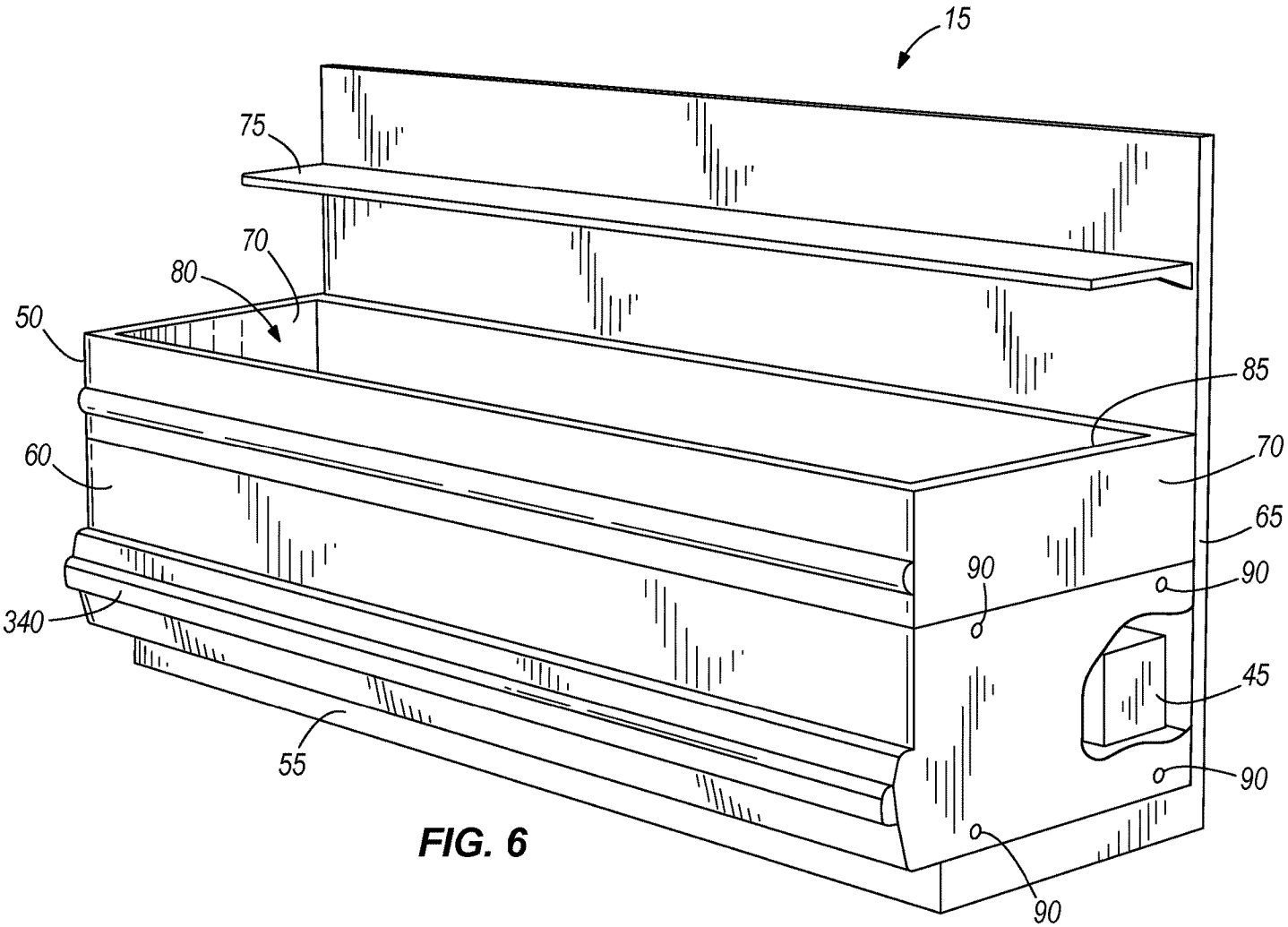
FIG. 6 is a perspective view of a low temperature center merchandiser module.

FIGS. 1, 2, and 6 show one construction of the first merchandiser module 15 defining a low temperature merchandiser module (e.g., a reach-in frozen food merchandiser) that includes at least a portion of a refrigeration system 45 (shown schematically in FIG. 6) having ducting internal to the module 15 to maintain product temperatures in the first merchandiser module 15 less than about 32 degrees Fahrenheit. As is known in the art, the refrigeration system 45 generally includes an evaporator through which refrigerant flows. The refrigerant in the evaporator absorbs heat, thereby decreasing the temperature of an airflow passing over the evaporator. The heated or gaseous refrigerant then exits the evaporator and is pumped back to one or more compressors. The cooled airflow exiting the evaporator via heat exchange with the liquid refrigerant is directed toward the product 13 via the ducting in the first merchandiser module 15 to maintain the product 13 at desired conditions.

Although the first merchandiser module 15 described with regard to FIGS. 1-3 and 6 includes a low temperature merchandiser module, other types of merchandiser modules for the first merchandiser module 15 are possible and considered herein. For example, the first merchandiser module 15 can include a medium temperature merchandiser module. In other constructions, the first merchandiser module 15 can include an ambient temperature merchandiser module. In still other constructions, the first merchandiser module 15 can include a high temperature merchandiser module.

As illustrated in FIG. 6, the first merchandiser module 15 includes a display case 50 that has a modular base 55, a front wall 60, a rear wall 65, opposed side walls 70, and a shelf 75 coupled to the rear wall 65. The modular base 55, the front wall 60, the opposed side walls 70, and the rear wall 65 cooperate to define a product display area 80 for supporting product 13 that is accessible by consumers via an opening 85 adjacent an upper end of the display case 50. In the illustrated construction, the display case 50 is a self-contained horizontal open display case. In some constructions, lids or doors may be provided over the opening 85 to limit heat transfer from the product display area 80 to the environment surrounding the display case 50. In other constructions, the display case 50 may include an upright or vertical display case that is provided with or without doors for access to the product display area 80.

The modular base 55 is disposed below the product display area 80 and is supported by a floor or support surface (not shown) of the supermarket. The modular base 55 defines a lower portion of the product display area 80 that can support a portion of the product 13 in the display case 50. In some constructions, each of the rear wall 65 and the side walls 70 can include attachment points 90 (e.g., openings).

Figure 7:
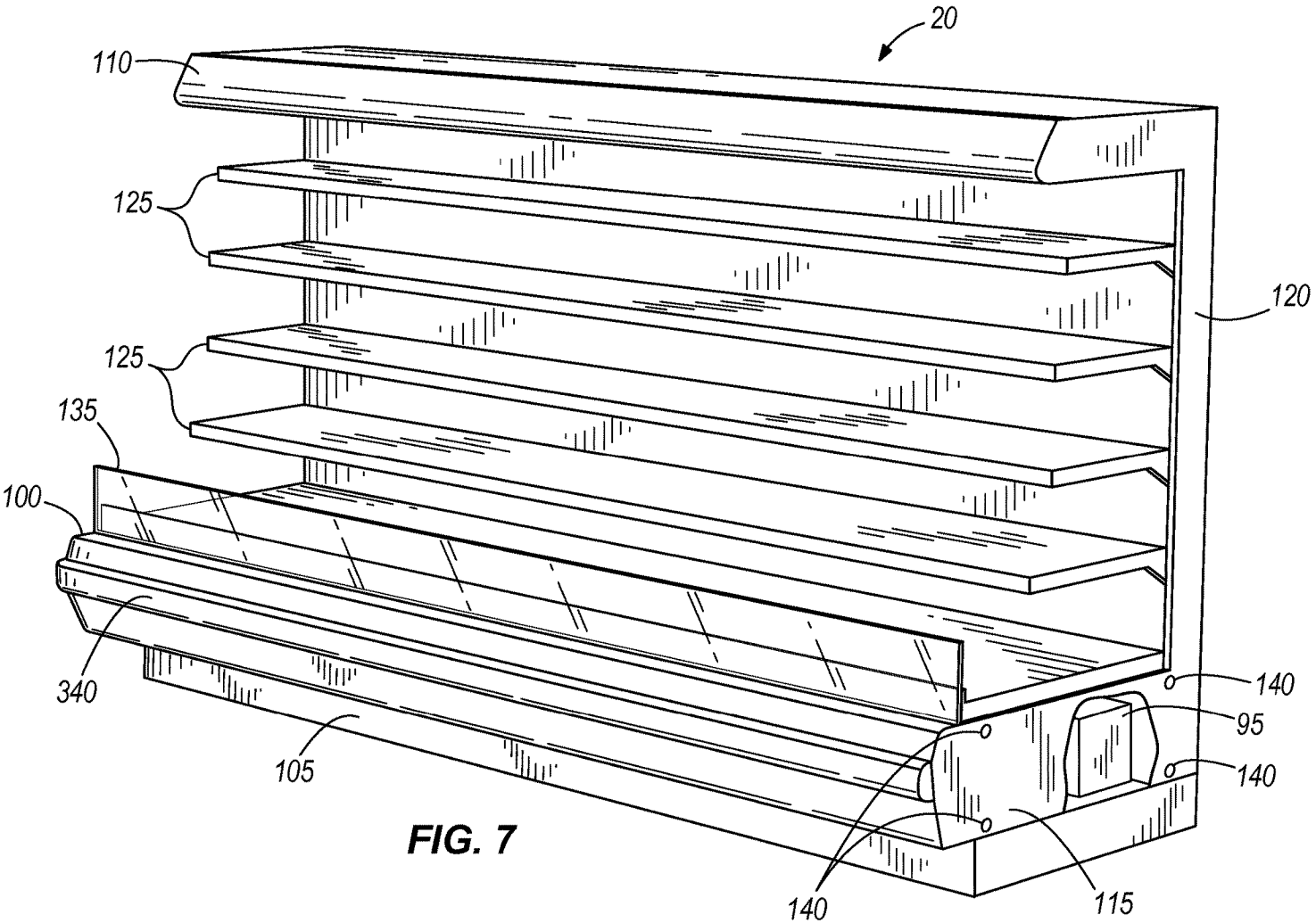
FIG. 7 is a perspective view of a medium temperature center merchandiser module.

FIG. 7 shows one construction of the second merchandiser module 20 defining a medium temperature merchandiser module (e.g., a meat merchandiser module, a deli and dairy merchandiser module, a produce merchandiser module, seafood merchandiser module, a beverage merchandiser module, etc.). The second merchandiser module 20 includes at least a portion of a refrigeration system 95 (shown schematically in FIG. 7) that has ducting internal to the module 20 to maintain product temperatures in the second merchandiser module 20 within a temperature range of approximately 32 degrees Fahrenheit to 41 degrees Fahrenheit. Similar to the refrigeration system 45 described with regard to FIG. 6, cooled airflow exiting an evaporator of the refrigeration system 95 via heat exchange with liquid refrigerant in the evaporator is directed toward the product 13 via the ducting in the second merchandiser module 20 to maintain the product 13 at desired conditions. In other constructions, the second merchandiser module 20 can include other types of merchandiser modules (e.g., a low temperature module, an ambient temperature module, or a high temperature module.

The second merchandiser module 20 includes a display case 100 that has a modular base 105, a canopy 110, side walls 115, a rear wall 120, and shelves 125 coupled to and extending outward from the rear wall 120. The modular base 105, the canopy 110, the side walls 115, and the rear wall 120 cooperate to define a product display area 130 for supporting product 13 on the shelves 125. The product display area 130 is accessible by consumers via an opening 135 adjacent the front of the display case 100. In the illustrated construction, the display case 100 is an upright or vertical display case 100 that is provided without doors for access to the product display area 130. In some constructions, one or more doors may be provided over the opening 135 to limit heat transfer from the product display area 130.

The modular base 105 is disposed below the product display area 130 and can be supported by the floor or support surface of the supermarket. The modular base 105 defines a lower portion of the product display area 130 that can support a portion of the product 13 in the display case 100.

With reference to FIGS. 1-3, the second merchandiser module 20 is positioned next and coupled to the first merchandiser module 15 such that the rear wall 120 of the second merchandiser module 20 is in communication with the rear wall 65 of the first merchandiser module 15. In some constructions, one or all of the side walls 115 and the rear wall can include attachment points 140 (e.g., openings) that are aligned with the attachment points 90 of the rear wall 65 of the first merchandiser module 15 so that the first and second merchandiser modules 15, 20 can be attached to each other via fasteners.

Figure 8:
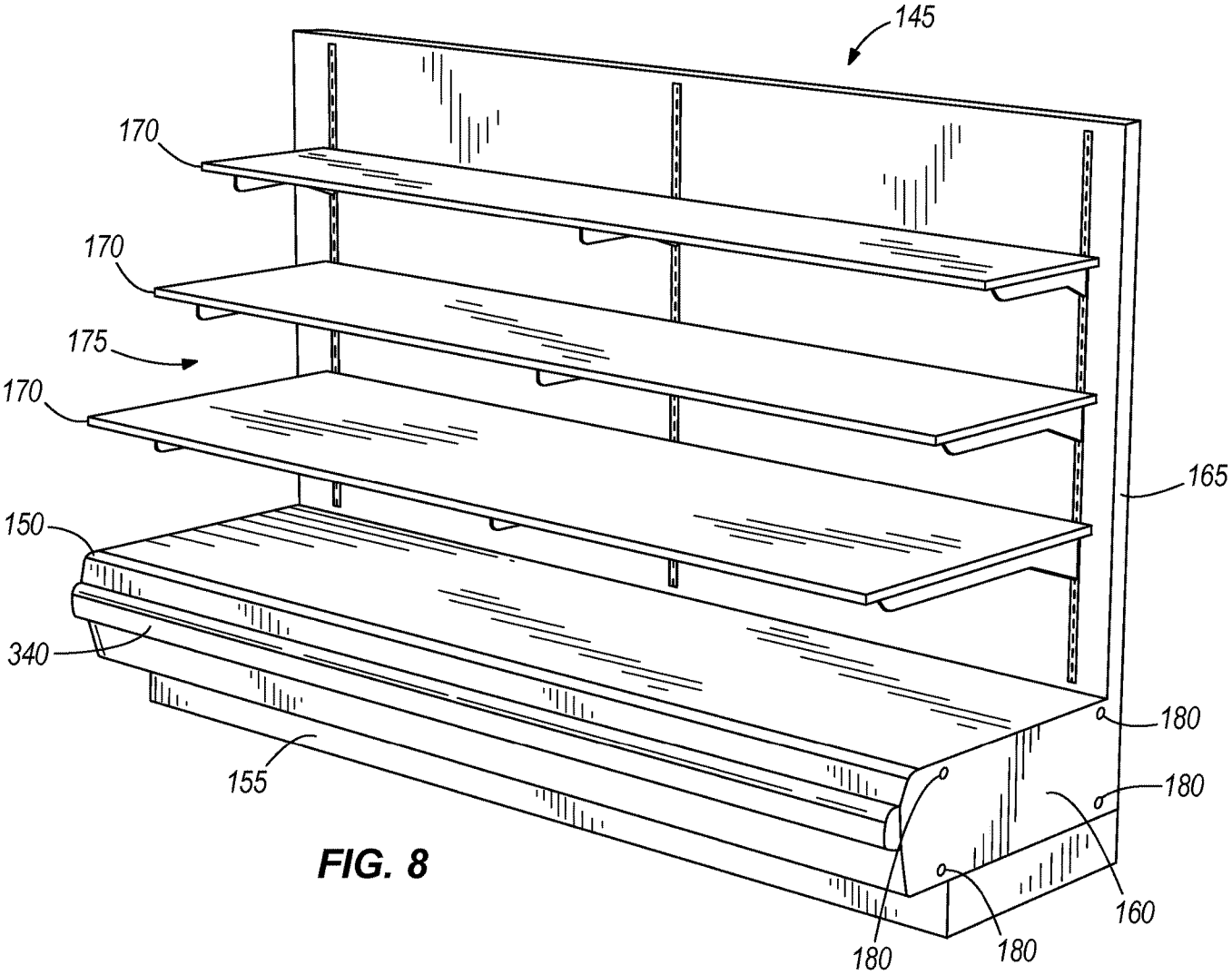
FIG. 8 is a perspective view of an ambient temperature center merchandiser module.

FIG. 8 shows another exemplary center merchandiser module 145 of the island merchandiser 10 that defines a dry shelf ambient temperature module. In some constructions, the merchandiser module 145 can include other types of ambient temperature merchandiser modules (e.g., a dry counter merchandiser module, a prepared foods merchandiser module, a specialized merchandiser module, etc.).

The merchandiser module 145 includes a display case 150 that has a modular base 155, side walls 160, a rear wall 165, and shelves 170 coupled to and extending from the rear wall 165 for supporting product 13. The modular base 155, the side walls 160, and the rear wall 165 cooperate to define a product display area 175 for supporting product 13 on the shelves 170. The product display area 175 is accessible by consumers from the front and or sides of the display case 150. The illustrated display case 150 is an upright or vertical display case 150 that is provided without doors for access to the product display area 175. In some constructions, the display case 150 may include walls (e.g., glass panels) that at least partially enclose the product display area 175. In these constructions, doors or lids may be provided to allow access to the product display area 175 from outside the display case 150.

The modular base 155 is disposed below the product display area 175 and can be supported by the floor or support surface of the supermarket. The base 155 defines a lower portion of the product display area 175 that can support a portion of the product 13 in the display case 150. In some constructions, either or both the side walls 160 and the rear wall 165 can include attachment points 180 (e.g., openings).

Figure 9:
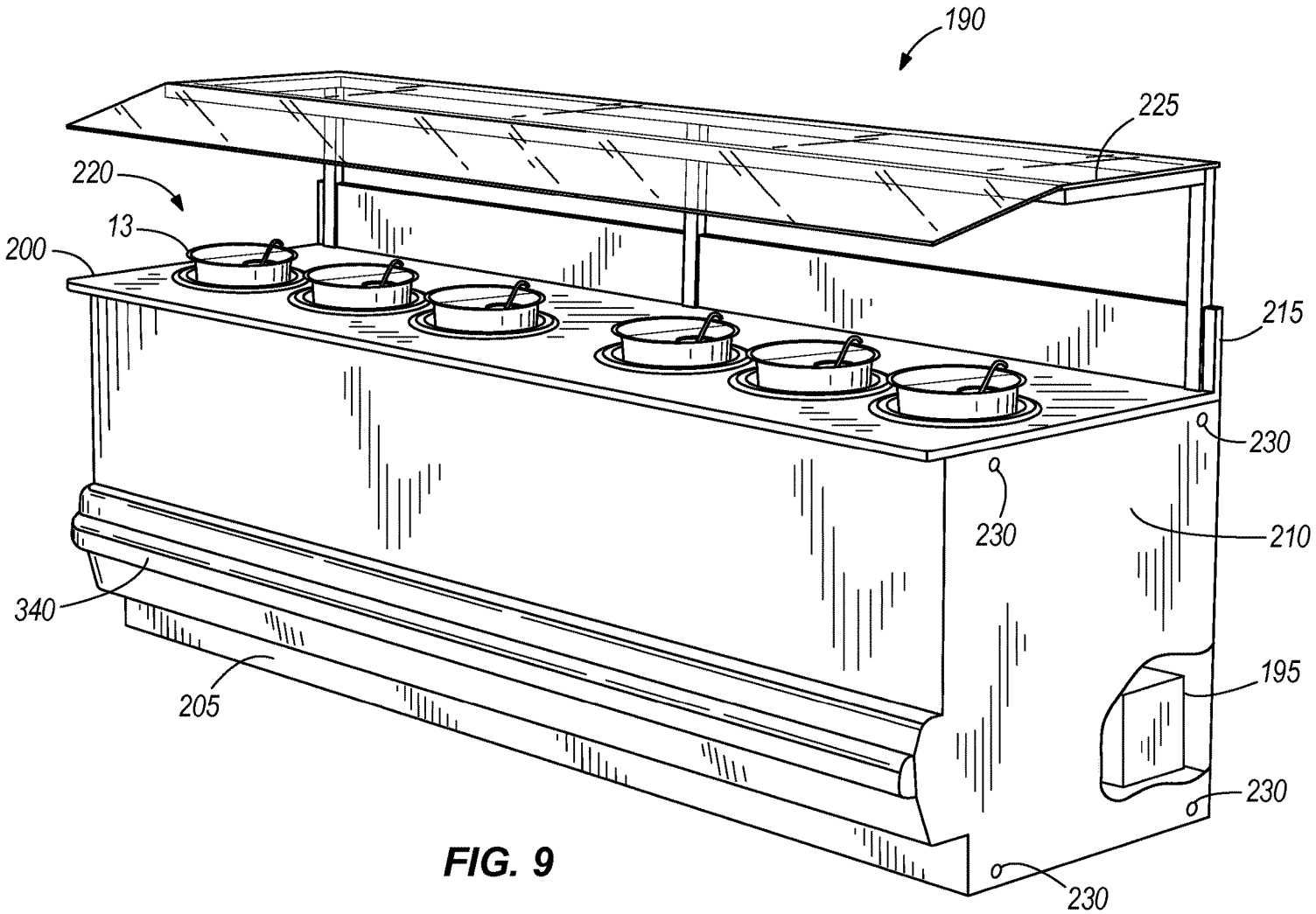
FIG. 9 is a perspective view of a high temperature center merchandiser module.

FIG. 9 shows another construction of a center merchandiser module 190 of the island merchandiser 10 that defines a high temperature soup merchandiser module. In some constructions, the merchandiser module 190 can include other types of high temperature merchandiser modules (e.g., a prepared foods merchandiser module, a specialized merchandiser module, etc.). As one of ordinary skill in the art will recognize, the merchandiser module 190 includes at least a portion of a heating system 195 that has ducting internal to the merchandiser module 190 to maintain product temperatures in the merchandiser module 20 within the desired temperature range (e.g., at or above 150 degrees Fahrenheit). Generally, air is heated by the heating system 195 and is then directed toward the product 13 in the merchandiser module 190 to maintain the product 13 at the desired conditions.

As illustrated in FIG. 9, the merchandiser module 190 includes a display case 200 that has a modular base 205, side walls 210, and a rear wall 215. The modular base 205, the side walls 210, and the rear wall 215 cooperate to define a product display area 220 for supporting product 13 that is accessible by consumers from adjacent the front and sides of the display case 200. A canopy 225 extends from the rear wall 215 over the product display area 220 to partially enclose the product display area 220.

The modular base 205 is disposed below the product display area 220 and can be supported by the floor or support surface of the supermarket. The modular base 205 defines a lower portion of the product display area 220 that can support a portion of the product 13 in the display case 200. In some constructions, either or both the side walls 210 and the rear wall 215 can include attachment points 230 (e.g., openings).

Figure 10:
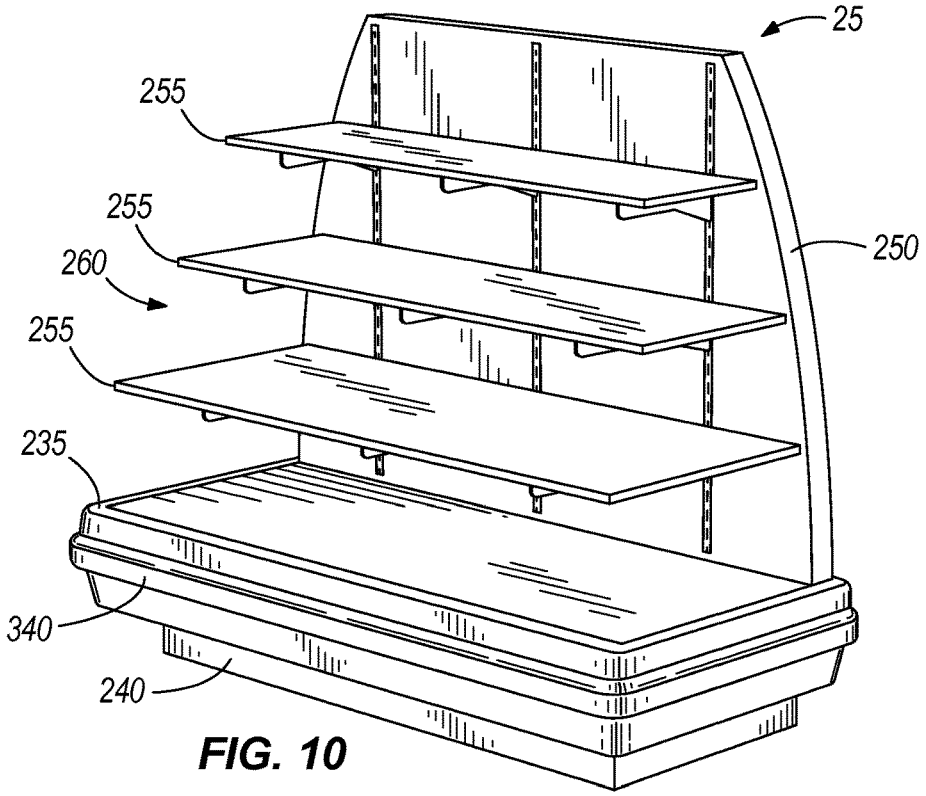
FIG. 10 is a perspective view of an ambient temperature end merchandiser module.

FIGS. 1, 2, and 10 show one construction of the third merchandiser module 25 defining an ambient temperature merchandiser module (e.g., a dry foods merchandiser). The illustrated third merchandiser module 25 utilizes the surrounding environment to maintain the product 13 generally within a temperature range between about 41 degrees Fahrenheit and 75 degrees Fahrenheit. In some constructions, the third merchandiser module 25 can include a refrigeration system or a heating system to control conditions (e.g., humidity, temperature) of the product 13 within the desired temperature range. In other constructions, the third merchandiser module 25 can include other types of merchandiser modules (e.g., a low temperature module, a medium temperature module, or a high temperature module).

Except for the length and the slight curvature of the third merchandiser module 25, the third merchandiser module 25 is similar to the merchandiser module 145 described with regard to FIG. 8. As illustrated in FIG. 10, the third merchandiser module 25 includes a display case 235 that has a modular base 240, a rear wall 250, and shelves 255 coupled to and extending from the rear wall 250. The modular base 240, the front wall 245, and the rear wall 250 cooperate to define a product display area 260 for supporting product 13 that is accessible by consumers from the front and sides of the display case 235. The illustrated display case 235 is an upright or vertical display case that is provided without doors for access to the product display area 260. The modular base 240 is disposed below the product display area 260 and is supported by a floor or support surface (not shown) of the supermarket. In some constructions, the rear wall 250 can include attachment points (e.g., openings).

With reference to FIGS. 1-3, the third merchandiser module 25 is positioned next and coupled to the first merchandiser module 15 and the second merchandiser module 20 such that the rear wall 250 of the third merchandiser module 25 is in communication with one side wall 70 of the first merchandiser module 15 and one side wall 115 of the second merchandiser module 20. In some constructions, the third merchandiser module 25 and the first and second merchandiser modules 15, 20 can be attached to each other via fasteners extending through the corresponding attachment points 90, 140 of the first and second merchandiser modules 15, 20, and the attachment points of the third merchandiser module 25.

Figure 11:
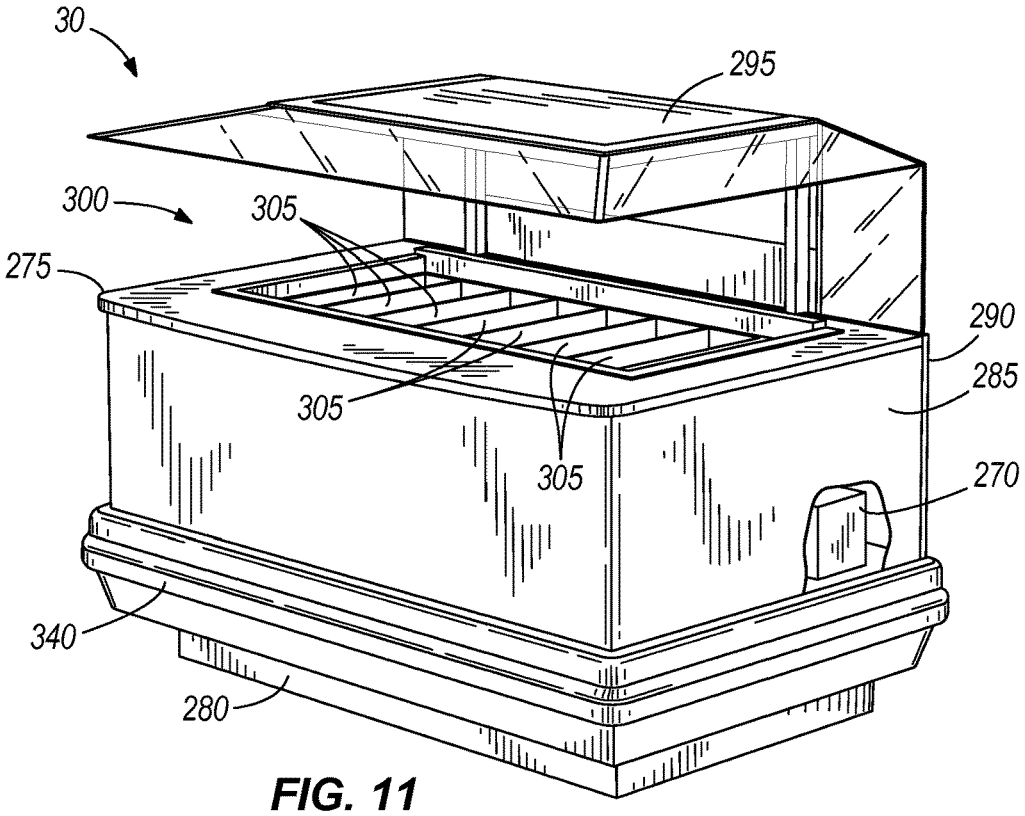
FIG. 11 is a perspective view of a high temperature end merchandiser module.

FIG. 11 shows one construction of the fourth merchandiser module 30 defining a high temperature prepared foods merchandiser module. In some constructions, the fourth merchandiser module 30 can include other types of high temperature merchandiser modules (e.g., a soup merchandiser module, a specialized merchandiser module, etc.). The fourth merchandiser module 30 includes at least a portion of a heating system 270 to maintain product temperatures in the fourth merchandiser module 30 within the desired temperature range (e.g., at or above 150 degrees Fahrenheit). The heating system 270 of the fourth merchandiser module 30 is similar to the heating system 195 described with regard to FIG. 9, and as such, the heating system 270 will not be discussed in detail. In other constructions, the fourth merchandiser module 30 can include other types of merchandiser modules (e.g., a low temperature module, a medium temperature module, or an ambient temperature module).

As illustrated in FIG. 11, the fourth merchandiser module 30 includes a display case 275 that has a modular base 280, side walls 285, a rear wall 290, and a canopy 295 extending from the rear wall 290 toward the front of the display case 275. The modular base 280, the side walls 285, the rear wall 290, and the canopy 295 cooperate to define a product display area 300 for supporting product 13 that is accessible by consumers from adjacent the front and sides of the display case 275. In the illustrated construction, the product display area 300 includes a plurality of compartments 305 for supporting various prepared food products 13. The modular base 280 is disposed below the product display area 300 and can be supported by the floor or support surface of the supermarket. In some constructions, the rear wall 290 can include attachment points (e.g., openings).

With reference to FIGS. 1-3, the fourth merchandiser module 30 is positioned next and coupled to the first merchandiser module 15 and the second merchandiser module 20 such that the rear wall 290 of the fourth merchandiser module 30 is in communication with one side wall 70 of the first merchandiser module 15 and one side wall 115 of the second merchandiser module 20 opposite the third merchandiser module 25. In some constructions, the fourth merchandiser module 30 and the first and second merchandiser modules 15, 20 can be attached to each other via fasteners extending through the corresponding attachment points 90, 140 of the first and second merchandiser modules 15, 20, and the attachment points of the fourth merchandiser module 30.

Figure 12:
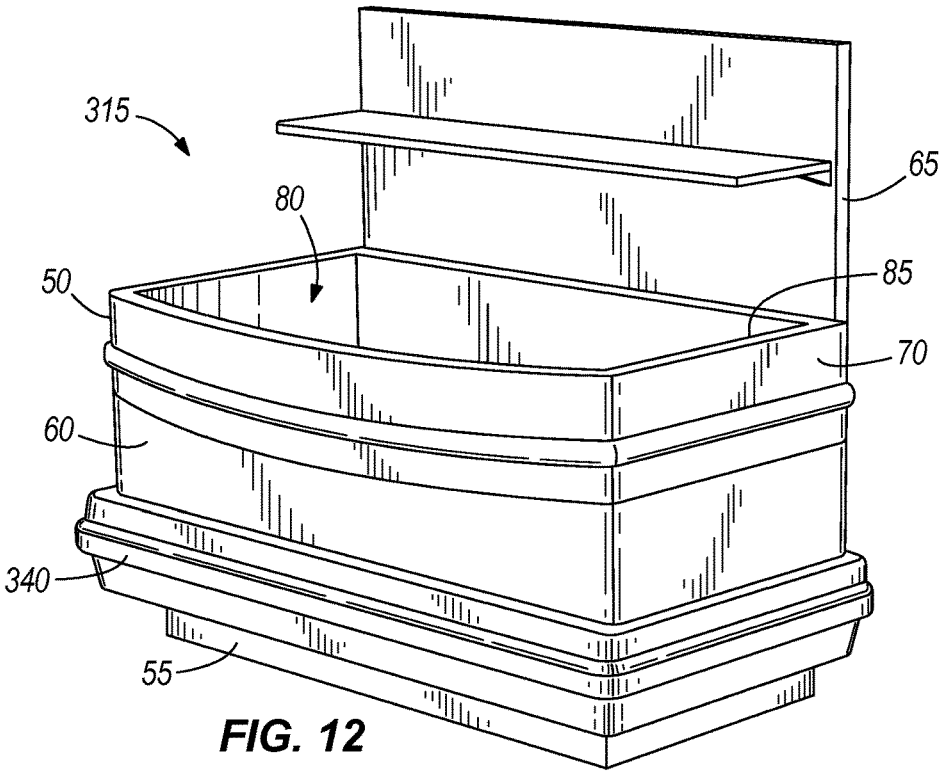
FIG. 12 is a perspective view of a low temperature end merchandiser module.

FIG. 12 shows an exemplary construction of a low temperature end merchandiser module 315 (e.g., a reach-in frozen foods merchandiser module) of the island merchandiser 10. In other constructions, the merchandiser module 315 can include other types of low temperature merchandiser modules (e.g., a specialized merchandiser module, etc.). Except as described below, the merchandiser module 315 is the same as the first merchandiser module 15 described with regard to FIGS. 1-3 and 6, and like elements are given the same reference numerals.

The merchandiser module 315 includes the display case 50 that has the modular base 55, the front wall 60, the rear wall 65, the side walls 70, and the shelf 75. The modular base 55, the front wall 60, the side walls 70, and the rear wall 65 cooperate to define the product display area 80. In the illustrated construction, the merchandiser module 315 has a length that is shorter than the length of the merchandiser module 15. Also, the front wall 60 has a slight longitudinal curvature, and only the rear wall 65 includes attachment points. Although not illustrated in FIG. 12, the merchandiser module 315 further includes the refrigeration system 45.

Figure 13:
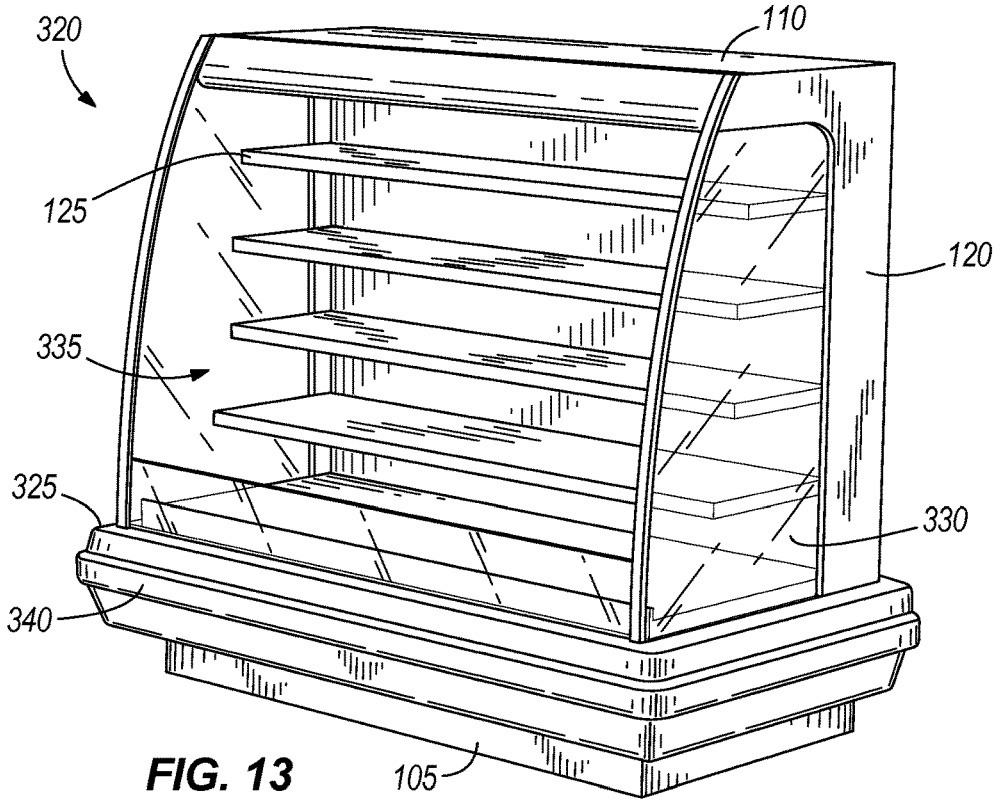
FIG. 13 is a perspective view of a medium temperature end merchandiser module.

FIG. 13 shows another construction of an end merchandiser module 320 of the island merchandiser 10 defining a medium temperature merchandiser module (e.g., a meat merchandiser module, a deli and dairy merchandiser module, a produce merchandiser module, seafood merchandiser module, a beverage merchandiser module, etc.). Except as described below, the merchandiser module 320 is the same as the second merchandiser module 20 described with regard to FIG. 7, and like elements have been given the same reference numerals.

The merchandiser module 320 includes a display case 325 that has the modular base 105, the canopy 110, the rear wall 120, the shelves 125, and side walls 330. The modular base 105, the canopy 110, the rear wall 120, and the side walls 330 cooperate to define a product display area 335. In the construction of the merchandiser module 320 illustrated in FIG. 13, the side walls 330 partially enclose the product display area 335 to limit heat transfer from the product display area 335 to the surrounding environment. The side walls 330 include translucent or transparent glass to permit viewing the product display area 335 from the sides of the display case 325. In some constructions, one or more doors may be provided over the front of the display case 325 to further limit heat transfer from the product display area 335 to the environment surrounding the display case 325.

Although the first, second, third, and fourth merchandiser modules 15, 20, 25, 30 have been described herein as defining one of a low temperature merchandiser module, a medium temperature module, an ambient temperature module, and a high temperature module, each of the first, second, third, and fourth merchandiser modules 15, 20, 25, 30 can include any one of these different types of merchandiser modules. For example, the island merchandiser 10 illustrated in FIGS. 1 and 2 show one each of a low temperature merchandiser module (the first merchandiser module 15), a medium temperature module (the second merchandiser module 20), an ambient temperature module (the third merchandiser module 25), and a high temperature module (the fourth merchandiser module 30). One or more of the merchandiser modules 15, 20, 25, 30 of the island merchandiser 10 can be replaced with a different temperature merchandiser module.

As illustrated by FIGS. 3-5 the island merchandiser 10, 35, 40 can include any combination of low temperature, medium temperature, ambient temperature, and high temperature merchandiser modules. In particular, any combination of two, three, or four merchandiser modules (e.g., two low temperature merchandiser modules, one medium temperature merchandiser module, and one ambient temperature merchandiser module, two ambient temperature merchandiser modules and two high temperature merchandiser modules, two medium temperature merchandiser modules and one ambient temperature merchandiser module, one medium temperature merchandiser module and one ambient temperature merchandiser module, etc.) is possible and considered herein.

With reference to FIGS. 1-5, each of the island merchandisers 10, 35, 40 includes a unitary base 340 that surrounds or encapsulates the merchandiser modules 15, 20, 25, 30 to provide a unified or uniform, seamless appearance for the corresponding island merchandiser 10, 35, 40. In some constructions, the unitary base 340 can be a common base permitting the selected quantity of merchandiser modules 15, 20, 25, 30 to be "dropped-in" without separate attachment of the merchandiser modules 15, 20, 25, 30 to each other. As shown in FIGS. 6-13, the illustrated unitary base 340 is incorporated into each merchandiser module 15, 20, 25, 30, 145, 190, 315, 320. In other constructions, the unitary base 340 may be attached to each merchandiser module 15, 20, 25, 30, 145, 190, 315, 320 after assembly next to each other.

In some constructions, one or more components (e.g., one or more compressors, condenser, valves, refrigerant piping, etc.) of the refrigeration systems 45, 95 of different merchandiser modules in the same island merchandiser (e.g., the first and second merchandiser modules 15, 20) can be shared with each other. In other constructions, the refrigeration systems 45, 95 can be substantially autonomous. Similarly, one or more components of the heating systems 195, 270 can be shared between the merchandiser modules 190, 270 of the same island merchandiser, or alternatively, the respective heating systems 195, 270 can be substantially autonomous relative to each other. Generally, the ducting of each merchandiser module 15, 20, 30, 190, 315, 320 is separate from the ducting of the remaining merchandiser modules to accommodate different temperatures associated with the respective product display areas 80, 130, 220, 300, 335.

Each island merchandiser 10, 35, 40 also includes a single electrical system that is shared by the merchandiser modules comprising the island merchandiser 10, 35, 40. FIGS. 1 and 2 show that the island merchandiser 10 further includes a first insulation panel 345 disposed between the first and second merchandiser modules 15, 20 and the third merchandiser module 25, and a second insulation panel 350 disposed between the first and second merchandiser modules 15, 20 and the fourth merchandiser module 30. The island merchandiser 10 can also include an insulation panel (not shown) between the first merchandiser module 15 and the second merchandiser module 20 to limit heat transfer between the first and second merchandiser modules 15, 20. In constructions of the island merchandiser 10 including similar-temperature merchandiser modules (e.g., ambient temperature merchandiser modules) positioned next to each other, the island merchandiser 10 may be provided without insulation panels between the proximate merchandiser modules.

The first insulation panel 345 is defined by a solid wall that is formed as part of one or both of the first and third merchandiser modules 15, 25 and as part of one or both of the second and third merchandiser modules 20, 25 to provide a seamless transition between the first and second merchandiser modules 15, 20 and the third merchandiser module 25. The wall includes insulation to limit heat transfer between the first and second merchandiser modules 15, 20 and the third merchandiser module 25. In other constructions, the first insulation panel 345 can include glass (e.g., double-paned glass) to provide product visibility between the first and third merchandiser modules 15, 25, and between the second and third merchandiser modules 20, 25.

The second insulation panel 350 is defined by a wall formed as part of one or both of the first and fourth merchandiser modules 15, 30 and as part of one or both of the second and fourth merchandiser modules 20, 30 to provide a seamless transition between the first and second merchandiser modules 15, 20 and the fourth merchandiser module 30. The second insulation panel 350 includes insulation to limit heat transfer between the first and second merchandiser modules 15, 20 and the fourth merchandiser module 30, and glass 355 (e.g., double-paned glass) that is coupled to the wall to provide product visibility between the first and fourth merchandiser modules 15, 30, and between the second and fourth merchandiser modules 20, 30. In other constructions, the second insulation panel 350 can include a substantially solid wall similar to the first insulation panel 345.

With reference to FIGS. 1-3, the island merchandiser 10 is assembled by positioning the first and second merchandiser modules 15, 20 next to each other in back-to-back relationship such that the rear walls 65, 120 are in communication with and coupled to each other. In constructions of the merchandiser modules 15, 20 including the respective attachment points 90, 140, fasteners can be used to affirmatively attach the modules 15, 20 to each other. Next, the third and fourth modules 25, 30 are positioned next to the first and second merchandiser modules 15, 20 on opposite sides to enclose the ends of the first and second merchandiser modules 15, 20. The respective rear walls 250, 290 of the third and fourth merchandiser modules 25, 30 are positioned in communication with and coupled to the side walls 70, 115 of the first and second merchandiser modules 15, 20. Fasteners can be used to affirmatively attach the modules to each other via the attachment points 90, 140, 265, 310.

In constructions of the island merchandiser 10 including the unitary base 340 as a separate component, the unitary base 340 is attached to the merchandiser modules 15, 20, 25, 30 after the modules have been positioned relative to each other. Assembly of each of the island merchandisers 35, 40 is the same as the assembly of the island merchandiser 10, except for the quantity and orientation of the respective merchandiser modules in each merchandiser 35, 40.

Each of the island merchandisers 10, 35, 40 illustrated in FIGS. 1-5 is shipped as a single unit to the retail setting to provide flexible product merchandising that meets the particular desires of the retail setting. In particular, each of the individual island merchandisers 10, 35, 40 provides an "endless" variety of combinations of merchandiser modules so that unique combinations of products 13 can be displayed in close proximity to each other.

For example, the island merchandiser 10 can be used to display complete meal solutions (e.g., meal solutions for all aspects of one meal). In particular, the first merchandiser module 15 of the island merchandiser 10 displays frozen foods (e.g., desserts) in the corresponding product display area 80 and accessory products 13 on the shelf 75. The second merchandiser module 20 displays refrigerated products 13 (e.g., sandwich meat, cheeses, etc.). The third merchandiser module 25 displays dry food products 13 (e.g., bread, chips, drinks, etc.). The fourth merchandiser module 30 displays prepared hot foods 13 (e.g., side dishes).

Alternatively, the island merchandiser 10, 35, 40 can display complementary soups and salads. The island merchandiser 10, 35, 40 may also be used to display customized seafood products 13 (e.g., lobster, shrimp, fish) and complementary products 13 (e.g., butter, seasonings, cooking utensils, lemons, etc.) in different merchandiser modules of the same island merchandiser 10, 35, 40. The island merchandiser 10, 35, 40 may also be used to display customized meat items and complementary deli products 13 (e.g., side dishes) in different merchandiser modules of the same merchandiser 10, 35, 40. Other combinations of merchandiser modules are possible and considered herein.

The two or more merchandiser modules in the island merchandiser 10, 35, 40 can provide the consumer with a one-stop shopping area in the retail setting. The flexible island merchandiser 10, 35, 40 provides a universal display platform based on modular merchandisers to provide a unified island merchandiser 10, 35, 40 that displays different and/or complementary products 13 in close proximity to each other.

Various features and advantages of the invention are set forth in the following claims.

The invention claimed is:

1. An island merchandiser comprising:

a first merchandiser module including a first case having side walls and a rear wall at least partially defining a first product display area, and at least a portion of a refrigeration system coupled to the first case and including an evaporator in communication with the first product display area to maintain the first product display area within a predetermined temperature range below approximately 41 degrees Fahrenheit such that the first merchandiser module defines one of a first medium temperature module and a first low temperature module;

a second merchandiser module positioned next to the first merchandiser module, the second merchandiser module including a second case having side walls and a rear wall at least partially defining a second product display area, the rear wall of the second case in communication with the rear wall of the first case so that the first merchandiser module and the second merchandiser module are positioned in a back-to-back relationship, the second merchandiser module defining one of a high temperature module, an ambient temperature module, a second medium temperature module, and a second temperature module; and a single, unitary base positioned to at least partially support each of the first and second merchandiser modules relative to a support surface, wherein the module defined by the second merchandiser module is different from the module defined by the first merchandiser module, and wherein the first merchandiser module and the second merchandiser module are positioned and configured to be dropped into the unitary base without separate attachment of the first merchandiser module to the second merchandiser module.

2. The island merchandiser of claim 1, wherein the rear wall of the first merchandiser module and the rear wall of the second merchandiser module are coupled to each other.

3. The island merchandiser of claim 1, wherein the base completely surrounds a lower portion of each of the first and second merchandiser modules.

4. The island merchandiser of claim 1, wherein the first merchandiser module includes a frozen food merchandiser, and wherein the second merchandiser module includes one of a meat merchandiser, a deli merchandiser, a seafood merchandiser, a beverage merchandiser, a dairy merchandiser, and a produce merchandiser.

5. The island merchandiser of claim 4, wherein the second merchandiser module is a medium temperature and shares at least a portion of the refrigeration system associated with the first merchandiser module to maintain the second product display area within a temperature range of approximately 32 degrees Fahrenheit and 41 degrees Fahrenheit.

6. The island merchandiser of claim 5, wherein the first merchandiser module includes ducting configured to distribute air to the product display area of the first case, and the second merchandiser module includes ducting configured to distribute air to the product display area of the second case, and wherein the ducting of the second merchandiser module is separate from the ducting of the first merchandiser module.

7. The island merchandiser of claim 1, wherein the product display area of the first merchandiser module is adapted to display a first type of product, and wherein the product display area of the second merchandiser module is adapted to display a second type of product complementary to the first type of product.

8. The island merchandiser of claim 1, further comprising an electrical system shared by the first merchandiser module and the second merchandiser module.

9. The island merchandiser of claim 1, wherein the first merchandiser module defines the first medium temperature module and the second merchandiser module defines the ambient temperature module.

10. The island merchandiser of claim 1, further comprising a third merchandiser module positioned next and coupled to the first merchandiser module and the second merchandiser module, wherein the third merchandiser module includes a third case having side walls and a rear wall at least partially defining a third product display area, the rear wall of the third case in communication with one of the side walls of each of the first case and the second case, and wherein the third merchandiser module defines a module that is operated at a different temperature relative to the first merchandiser module and the second merchandiser module.

11. A method of assembling an island merchandiser, the method comprising:

positioning a first merchandiser module in a single, unitary base, the first merchandiser module including a first case having side walls and a rear wall at least partially defining a first product display area maintained at a temperature below approximately 41 degrees Fahrenheit;

positioning a second merchandiser module in the unitary base adjacent the first merchandiser module, the second merchandiser module including a second case having side walls and a rear wall at least partially defining a second product display area maintained at a temperature above approximately 32 degrees Fahrenheit;

positioning a third merchandiser module in the unitary base adjacent the first merchandiser module and the second merchandiser module, the third merchandiser module including a third case having side walls and a rear wall at least partially defining a third product display area maintained at a temperature above approximately 41 degrees Fahrenheit;

orienting the first merchandiser module and one of the second merchandiser module and the third merchandiser module in back-to-back relationship;

orienting the other of the second merchandiser module and the third merchandiser module relative to the first merchandiser module so that the rear wall of the other of the second merchandiser module and the third merchandiser module is in communication with one of the side walls of the first merchandiser module; and after positioning and orienting the first, second, and third merchandiser modules in the unitary base, placing the island merchandiser on a support surface in a retail setting, wherein positioning each of the first merchandiser module, the second merchandiser module, and the third merchandiser module in the unitary base includes dropping in each module into the unitary base without separate attachment of each the first merchandiser module, the second merchandiser module, and the third merchandiser module to one another.

12. The method of claim 11, further comprising refrigerating two of the merchandiser modules using a refrigeration system shared by the two merchandiser modules.

13. The method of claim 11, further comprising powering the first merchandiser module, the second merchandiser module, and the third merchandiser module with a single, shared electrical system.

14. The method of claim 11, further comprising orienting the first merchandiser module and the second merchandiser module in back-to-back relationship;

orienting the third merchandiser module relative to the first merchandiser module so that the rear wall of the third merchandiser module is in communication with the side wall of the first merchandiser module; and insulating the third product display area relative to the first product display area using double-paned glass.

15. An island merchandiser comprising:

a first merchandiser module including a first case having side walls and a rear wall at least partially defining a first product display area, and at least a portion of a refrigeration system coupled to the first case and including an evaporator in communication with the first product display area to maintain the first product display area within a predetermined temperature range below approximately 41 degrees Fahrenheit such that the first merchandiser module defines one of a first medium temperature module and a first low temperature module;

a second merchandiser module positioned next to the first merchandiser module, the second merchandiser module including a second case having side walls and a rear wall at least partially defining a second product display area, the rear wall of the second case in communication with the rear wall of the first case so that the first merchandiser module and the second merchandiser module are positioned in a back-to-back relationship, the second merchandiser module defining one of a high temperature module, an ambient temperature module, a second medium temperature module, and a second temperature module; and a third merchandiser module positioned next to the first merchandiser module and the second merchandiser module, the third merchandiser module including a third case having side walls and a rear wall at least partially defining a third product display area, the rear wall of the third case in communication with one of the side walls of each of the first case and the second case; and a base positioned to at least partially support each of the first, second, and third merchandiser modules relative to a support surface, wherein the module defined by the second merchandiser module is different from the module defined by the first merchandiser module, wherein the rear wall of the third case is sized and shaped to conform to the cooperative size and shape of the side walls of the first case and the second case, and wherein the first merchandiser module, the second merchandiser module, and the third merchandiser module are positioned and configured to be dropped into the unitary base without separate attachment of each the first merchandiser module, the second merchandiser module, and the third merchandiser module to one another.

16. The island merchandiser of claim 15, wherein the rear wall of the third case has an opaque section and translucent sections extending laterally from the rear wall, and wherein the opaque section is in communication with and is sized ad shaped to match the size and shape of the side walls of each of the first case and the second case.

17. The island merchandiser of claim 16, wherein the translucent sections define insulative boundaries between the second product display area and the third product display area, and between the first product display area and the third product display area.

18. The island merchandiser of claim 15, wherein the first merchandiser module includes ducting configured to distribute air to the first product display area, and the second merchandiser module includes ducting configured to distribute air to the second product display area, and wherein the ducting of the second merchandiser module is separate from the ducting of the first merchandiser module.

19. The island merchandiser of claim 15, wherein the base is a unitary base that completely surrounds a lower portion of each of the first and second merchandiser modules.

20. The island merchandiser of claim 15, further comprising an electrical system shared by the first merchandiser module, the second merchandiser module, and the third merchandiser module.

21. The island merchandiser of claim 15, wherein the first merchandiser module and the second merchandiser module each include a refrigeration system, and wherein a portion of the refrigeration system of the first merchandiser module is shared with the refrigeration system of the second merchandiser module.

* * * * *